US006545411B1

(12) United States Patent
Kim et al.

(10) Patent No.: US 6,545,411 B1
(45) Date of Patent: Apr. 8, 2003

(54) CAPILLARY DISCHARGE PLASMA DISPLAY PANEL WITH OPTIMUM CAPILLARY ASPECT RATIO

(75) Inventors: Dae-Il Kim, Riverdale, NJ (US); Steven Kim, Harrington Park, NJ (US); William Kokonaski, Gig Harbor, WA (US)

(73) Assignee: Plasmion Displays, LLC, Roanoke, VA (US)

( * ) Notice: Subject to any disclaimer, the term of this patent is extended or adjusted under 35 U.S.C. 154(b) by 0 days.

(21) Appl. No.: 10/040,951

(22) Filed: Jan. 9, 2002

(51) Int. Cl.[7] ..... H01J 17/49; H01J 9/00; G09G 3/10

(52) U.S. Cl. ..... 313/582; 313/584; 313/586; 445/24; 315/169.4

(58) Field of Search ..... 313/582, 583–587; 445/24; 315/169.4, 169.3

(56) References Cited

U.S. PATENT DOCUMENTS 5,701,056 A * 12/1997 Shinohara ..... 313/584
6,140,759 A * 10/2000 Sreeram et al. ..... 313/493
6,255,777 B1 * 7/2001 Kim et al. ..... 313/582
6,475,049 B2 * 11/2002 Kim et al. ..... 445/24

* cited by examiner

*Primary Examiner*—Don Wong
*Assistant Examiner*—Tuyet T. Vo
(74) *Attorney, Agent, or Firm*—Morgan, Lewis & Bockius LLP

(57) ABSTRACT

A capillary discharge plasma display panel with an optimized capillary aspect ratio is disclosed in the present invention. More particularly, a capillary discharge plasma display panel includes first and second substrates, at least one first electrode on the first substrate, a first dielectric layer on the first electrode including the first substrate, at least one second electrode on the second substrate, a second dielectric layer on the second electrode including the second substrate, wherein the second dielectric layer has at least one capillary discharge site corresponding to each second electrode and the capillary discharge site has a diameter approximately twice as great as a depth, thereby generating a continuous plasma discharge from the capillary discharge site, and at least one discharge space between the first and second dielectric layers.

7 Claims, 5 Drawing Sheets

CAPILLARY DISCHARGE PLASMA DISPLAY PANEL WITH OPTIMUM CAPILLARY ASPECT RATIO

BACKGROUND OF THE INVENTION

1. Field of the Invention

The present invention relates to a plasma display panel, and more particularly, to a capillary discharge plasma display panel with an optimum capillary aspect ratio. Although the present invention is suitable for a wide scope of applications, it is particularly suitable for achieving high brightness as well as high luminance efficiency in the capillary discharge plasma display panel (CDPDP).

2. Discussion of the Related Art

A plasma display panel (PDP) has been the subject of extensive research and development in the display industry because it can be realized as a thin and large sized flat panel device. Both AC and DC-operated plasma display panel structures have been developed in the PDP.

The DC-operated PDP employs DC electrodes that are in direct contact with the gas, but has to employ current limiting devices such as a resistor in the drive circuit or the discharge cell to prevent an excessive current flow when the gas discharges. In order to confine the discharge area within a pixel, dielectric barriers are positioned between the pixel and prevent the cross talk due to the spread of the ionized gas.

As well known, a dielectric layer is the most commonly used insulating layer that prevents destructive arc discharge in the AC plasma display panel. An expanded respective view of a conventional coplanar barrier type AC plasma display panel is illustrated in FIG. 1.

As shown in FIG. 1, the conventional barrier type AC PDP includes front and rear glass substrates 11 and 12 that enclose a discharge gas (not shown) filled in a discharge space 13. A plurality of bus electrodes 14 and corresponding ITO electrodes 15 are formed on the front glass substrate 11. Both the bus electrodes 14 and the ITO electrode 15 are completely covered with a first dielectric layer 16. Similarly, a plurality of address electrodes 17 is formed on the rear glass substrate 12 and is also completely buried by a second dielectric layer 18 in order to prevent arc discharge on the surface of the address electrode 17.

Further, a plurality of barrier ribs 19 define the discharge space 13. A phosphor layer 20 is formed on the inner walls of the barrier ribs 19, so that the generated UV light is converted into visible light.

However, the conventional barrier type AC PDP generates low-density plasma, resulting in low brightness and a slow response time due to a long discharge time on the dielectric wall.

SUMMARY OF THE INVENTION

Accordingly, the present invention is directed to a capillary discharge plasma display panel with an optimum capillary dimension that substantially obviates one or more of the problems due to limitations and disadvantages of the related art.

Another object of the present invention is to provide a capillary discharge plasma display panel with an optimum capillary dimension that provides high brightness as well as a fast response time.

Additional features and advantages of the invention will be set forth in the description that follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a capillary discharge plasma display panel includes first and second substrates, at least one first electrode on the first substrate, a first dielectric layer on the first electrode including the first substrate, at least one second electrode on the second substrate, a second dielectric layer on the second electrode including the second substrate, wherein the second dielectric layer has at least one capillary discharge site corresponding to each second electrode and the capillary discharge site has a diameter approximately twice as great as a depth, thereby generating a continuous plasma discharge from the capillary discharge site, and at least one discharge space between the first and second dielectric layers.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 1:
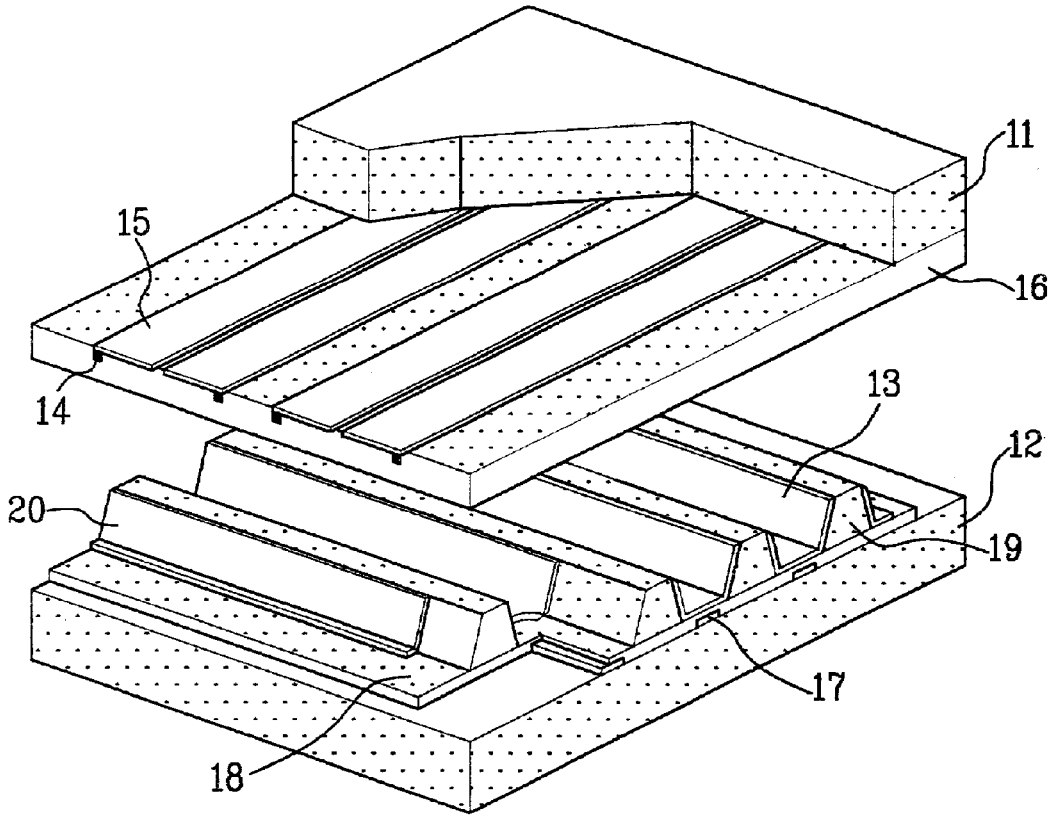
FIG. 1 is an expanded perspective view of a conventional coplanar barrier type AC plasma display panel.
Figure 2:
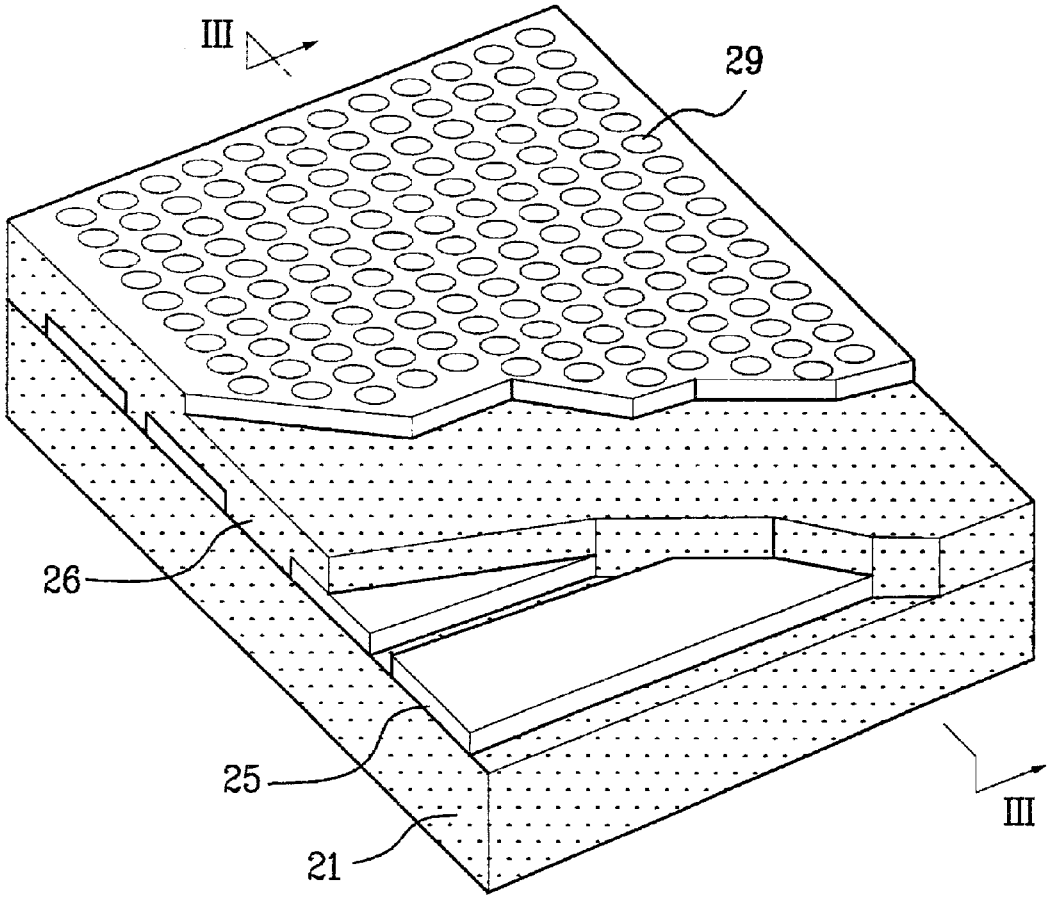
FIG. 2 is a schematic perspective view of a front substrate of a capillary discharge plasma display panel with an optimum capillary dimension according to the present invention.

FIG. 2 is a schematic perspective view of a front substrate of a capillary discharge plasma display panel in accordance with the present invention.

As shown in FIG. 2, a capillary discharge plasma display panel includes a glass substrate 21, at least one metal electrode 25 on the glass substrate 21, a dielectric layer 26 covering the metal electrode 25 including the front substrate 21.

In the dielectric layer 26, a plurality of capillary discharge sites 29 are formed therein to provide continuous plasma discharge sites.

The metal electrode 25 on the glass substrate 21 is transparent to visible light. For example, the metal electrode may be formed of indium tin oxide (ITO). Also, The dielectric layer 26 is transparent to visible light. The dielectric layer 26 may be formed of lead oxide (PbO) for this purpose.

For AC driving, the dielectric layer 26 is formed to completely cover the metal electrode 25 and separates the metal electrode 25 from discharge spaces (not shown).

A detailed structure of a rear substrate is not illustrated in the present invention. Similar to the rear substrate of the conventional coplanar type AC plasma display panel, on the glass substrate, a plurality of address electrodes are formed thereon. A dielectric layer covers the address electrodes including the glass substrate. A pair of barrier ribs on the dielectric layer define each discharge space. On the inner walls of the barrier ribs, an UV-visible conversion layer such as phosphor is formed thereon. Additionally, a protective layer such as magnesium oxide may also be formed on both the dielectric layers of the front and rear substrates.

Figure 3A:
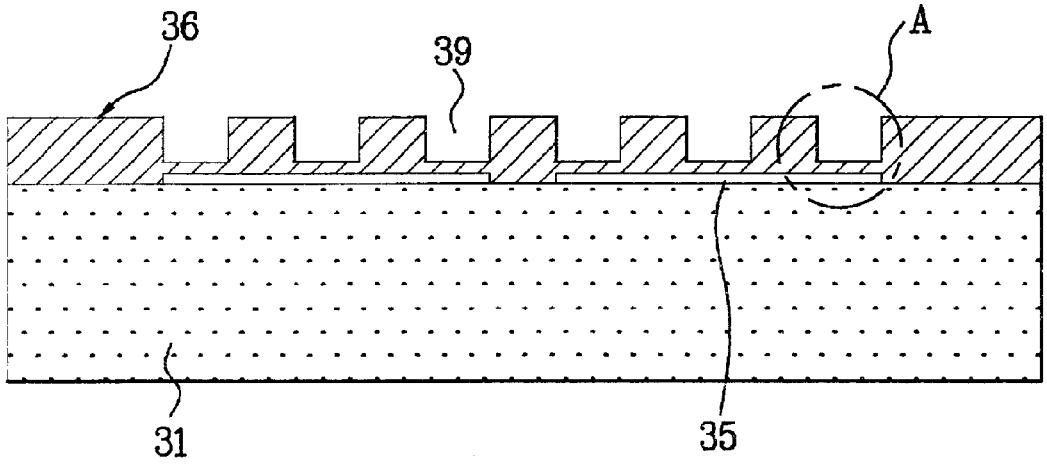
FIGS. 3A and 3B are a cross-sectional view along with line III—III of FIG. 2 and an enlarged view of the portion "A" of FIG. 3A of the capillary discharge site, respectively.
Figure 3B:
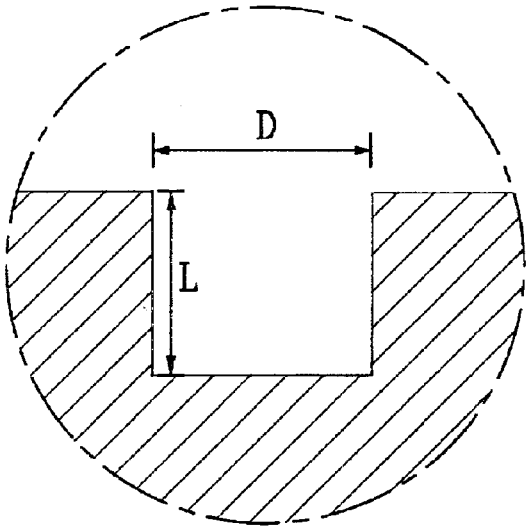

FIGS. 3A and 3B are a cross-sectional view along with line III—III of FIG. 2 and an enlarged view of the portion "A" of FIG. 3A of the capillary discharge site, respectively.

As shown in FIG. 3A, at least one capillary discharge site 39 is formed over a metal electrode 35. The bottom of the capillary site 39 does not expose any portion of the metal electrode 35, so that the vertical end of the capillary discharge site is separated by a dielectric layer 36. For example, a diameter of the capillary discharge site 39 may be in the range of about 20 to 1000 $\mu$m. A depth of the capillary discharge site 39 may be in the range of about 10 to 500 $\mu$m.

As shown in FIG. 3B, a diameter and a depth of the capillary discharge site are referred to as "D" and "L", respectively. A dimension such as the diameter and the depth of the capillary discharge site is critical in optimizing the capillary discharge characteristic.

An aspect ratio is defined as "D/L", in the present invention. In order to optimize the dimension of the capillary discharge site, various aspect ratios are tested in the present invention.

An intensity of the UV emission in the capillary discharge is measured in terms of infrared (IR). The UV emission of 147 nm using Xenon is proportional to the IR emission of 828 nm. Thus, by measuring the IR emission, a relative amount of the UV emission is detected in the present invention.

Figure 4:
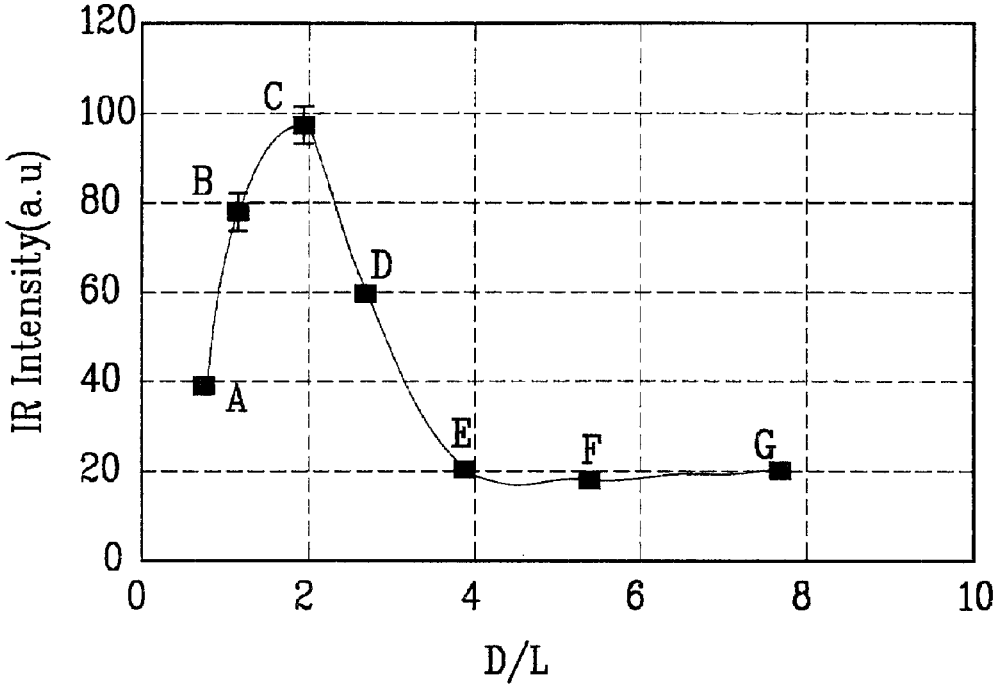
FIG. 4 is a graph illustrating a relationship between an IR intensity and an aspect ratio of the capillary according to the present invention.

IR intensities of the various aspect ratios of the capillary discharge sites are shown in FIG. 4.

As shown in FIG. 4, the IR intensity is increased with the increase of D/L until D/L is approximately 2. When D/L is larger than 2, the IR intensity decreases. For D/L of larger than 4, the IR intensity does not depend upon D/L.

Figure 5:
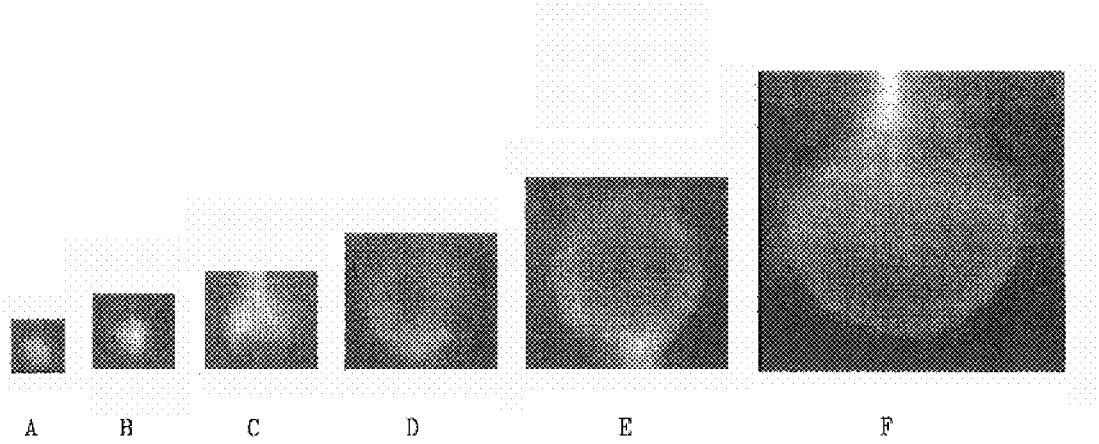
FIG. 5 is photographs taken by an IR camera illustrating plasma discharges with different aspect ratios according to the present invention.

FIG. 5 is photographs taken by an IR camera illustrating capillary discharge with different aspect ratios. As shown in FIG. 4B, the point D, which represents the D/L ratio of approximately 2, is most visible and brighter than the other aspect ratios.

As shown in FIGS. 4 and 5, the intensity of the capillary discharge at the aspect ratio of approximately 2 is larger than those at the other D/L ratios for the same conditions.

It will be apparent to those skilled in the art that various modifications and variations can be made in the capillary discharge plasma display with an optimum capillary aspect ratio without departing from the spirit or scope of the inventions. Thus, it is intended that the present invention covers the modifications and variations of this invention provided they come within the scope of the appended claims and their equivalents.

What is claimed is:

1. A capillary discharge plasma display panel, comprising:

first and second substrates;

at least one first electrode on the first substrate;

a first dielectric layer on the first electrode including the first substrate;

at least one second electrode on the second substrate;

a second dielectric layer on the second electrode including the second substrate, wherein the second dielectric layer has at least one capillary discharge site corresponding to each second electrode and the capillary discharge site has a diameter approximately twice as great as a depth, thereby generating a continuous plasma discharge from the capillary discharge site; and at least one discharge space between the first and second dielectric layers.

2. The plasma display panel according to claim 1, further comprising a magnesium oxide layer on the first and second dielectric layers.

3. The plasma display panel according to claim 1, further comprising at least a pair of barrier ribs to define the discharge space.

4. The plasma display panel according to claim 1, further comprising an UV-visible conversion layer on each inner wall of the discharge space.

5. The plasma display panel according to claim 1, wherein the second dielectric layer separates a bottom of the capillary discharge site and the second electrode.

6. The plasma display panel according to claim 1, wherein the diameter is in the range of about 20 to 1000 $\mu$m.

7. The plasma display panel according to claim 1, wherein the depth is in the range of about 10 to 500 $\mu$m.

* * * * *